US005660194A

United States Patent [19]

Sanders

[11] Patent Number: 5,660,194

[45] Date of Patent: Aug. 26, 1997

[54] WASHING SYSTEM FOR PRE-WASH TANKS

[75] Inventor: Phillip L. Sanders, Floyds Knobs, Ind.

[73] Assignee: Food Equipment Engineer and Design, Inc., Jeffersonville, Ind.

[21] Appl. No.: 564,595

[22] Filed: Nov. 29, 1995

[51] Int. Cl.[6] ..... B08B 3/02

[52] U.S. Cl. ..... 134/57 R; 134/107; 134/108; 134/111; 134/191; 134/195; 134/199

[58] Field of Search ..... 134/57 R, 104.1, 134/107, 108, 111, 115 R, 191, 195, 199

[56] References Cited

U.S. PATENT DOCUMENTS

| | | | |
|---|---|---|---|
| 1,961,548 | 6/1934 | Caise | 134/111 X |
| 2,746,467 | 5/1956 | Dempsey et al. | 134/111 |
| 4,462,415 | 7/1984 | Otzen | 134/111 |
| 4,589,158 | 5/1986 | Sheldon | 134/111 X |
| 4,637,413 | 1/1987 | Llewellyn et al. | 134/111 |
| 4,773,436 | 9/1988 | Cantrell et al. | 134/111 X |
| 5,464,033 | 11/1995 | Hartnell | 134/111 X |

FOREIGN PATENT DOCUMENTS

| | | | |
|---|---|---|---|
| 12936 | of 1916 | United Kingdom | 134/195 |

*Primary Examiner*—Philip R. Coe

*Attorney, Agent, or Firm*—Middleton & Reutlinger; Charles G. Lamb

[57] ABSTRACT

A wash water system for retrofitting a pre-wash tank or sink includes a plurality of spray nozzles which extend along an inner surface of a back wall of a pre-wash sink wherein the spray nozzles are in flow communication with a discharge side of a water circulating pump. A return conduit is provided wherein the return conduit extends vertically downward along the inner back wall of the sink a preselected distance and is in flow communication with a suction or intake side of said pump. The sink is provided with a bottom wall with at least one opening therein and a heater is provided with a conduit extending from the heater to and in flow communication with the opening in the bottom wall of the sink. A vertically extending first filter device is placed along the back wall of the sink over the openings into the return conduits to the suction side of the pump and a second filter device is placed over the opening in the bottom wall of the sink.

37 Claims, 7 Drawing Sheets

WASHING SYSTEM FOR PRE-WASH TANKS

BACKGROUND OF THE INVENTION

This invention relates to a pre-wash system for the washing of pots, pans, dishes, and utensils for eating. More particularly, this invention relates to a pre-wash system which may be retrofitted for an existing wash or pre-wash sink.

Pre-wash tanks for the washing of pots, pans, dishes, and utensils in restaurant facilities are well known. In most of these pre-wash systems, it is necessary to scrape the pots, pans, dishes and utensils prior to placing these items into an automatic washing machine. In many systems, a second pre-wash step is provided to further remove particles from the pots, pans, and the like. One such system is taught in U.S. Pat. No. 4,773,436 wherein the washing system disclosed therein includes a pre-wash sink which is only one sink in a wash system including a plurality of sinks. The pre-wash sink is downstream of or follows a scraping step wherein the heavy or large particles of food contained in the pots, pans, dishes and the like are removed prior to being subjected to this second pre-wash step. The sink and cleaning system disclosed in this patent is relatively complex and expensive.

SUMMARY OF THE INVENTION

An object of the present invention is to provide a pre-wash system for the washing of pots, pans, dishes and utensils in a washing facility in a restaurant or other type of food service location.

Another object of this invention is to provide a pre-wash system for restaurant washing facilities including easily removable intake and outlet water pipes from a pre-wash sink.

Even another object of this invention is to provide a simple constructed and economical wash system for a pre-wash tank in a restaurant facility.

An even further object of this invention is to provide a retro-fit pre-washing system for an existing pre-wash tank in a washing system in a restaurant or similar type facility which includes at least two sinks in the washing system.

More particularly, the present invention provides a recycle wash water system for a sink in a washing system comprising:

- a pump;
- a spray means in flow communication with the discharge of said pump, said spray means including spray nozzles positioned along the interior surface of a back wall of a sink;
- a liquid return conduit from said sink to an intake side of said pump, said return conduit being positioned along the inner surface of said back wall; and
- filter means disposed over openings into said return conduits.

Even more particularly, the present invention provides for a convection heat means for use in combination with a recycle retro-fit pre-washing system.

Further objects and advantages of this invention will appear to those skilled in the art upon reading the following description and appended claims, reference being made to the accompanying drawings forming a part of the specification wherein like reference characters designate corresponding parts into several views.

DETAILED DESCRIPTION OF THE PREFERRED EMBODIMENT

Figure 1:
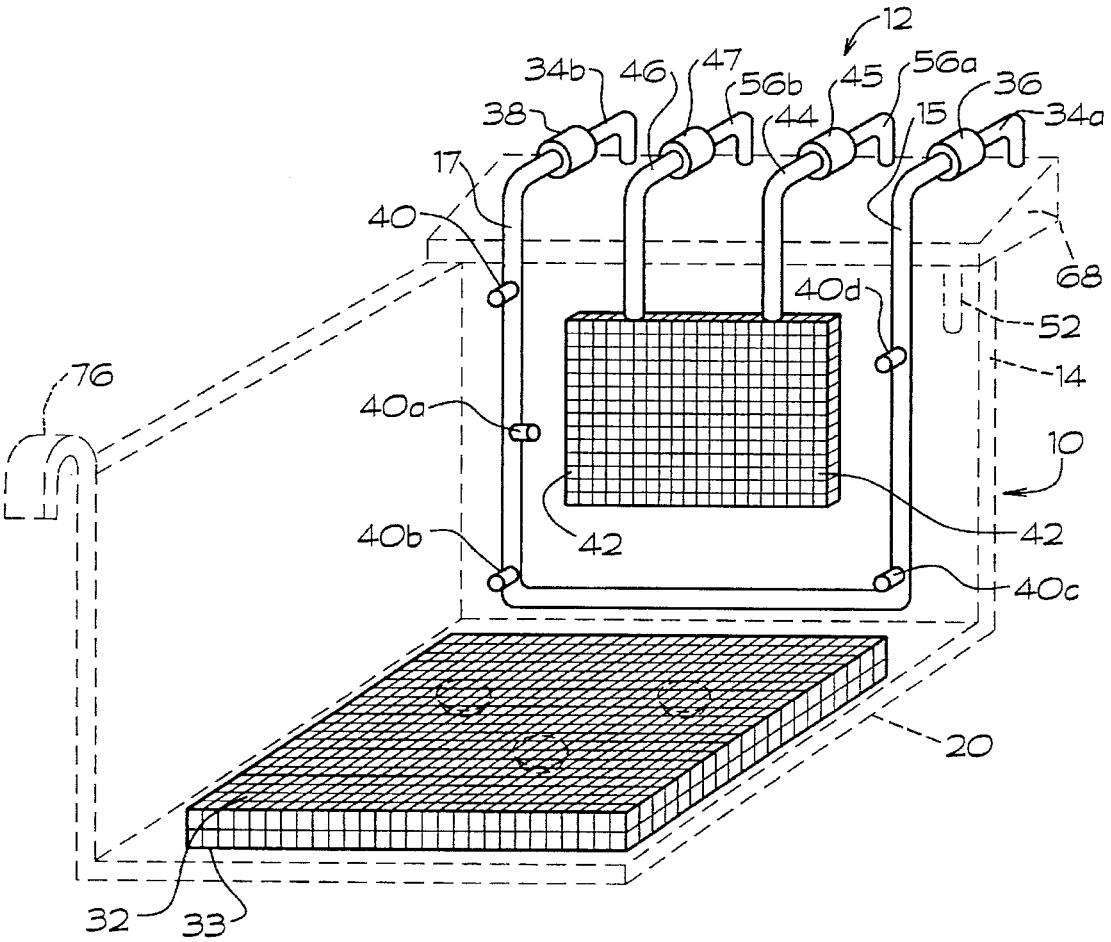
FIG. 1 is a perspective view of one preferred embodiment of the present invention as shown, with selected portions of a pre-wash sink shown in phantom lines.

Referring to FIG. 1, a sink 10 which is used for the pre-washing of pots, pans, dishes, eating utensils and the like is shown. A pre-wash system 12 which is or may be a retro-fit for the sink 10, is provided to assist in the removal or dislodging of food particles from the pots, pans, and the like prior to further washing for the removal of bacteria and other solid particles still clinging thereto. Generally, the additional wash steps are carried out in other sinks adjacent to sink 10, the adjacent wash sinks not being shown.

Figure 2:
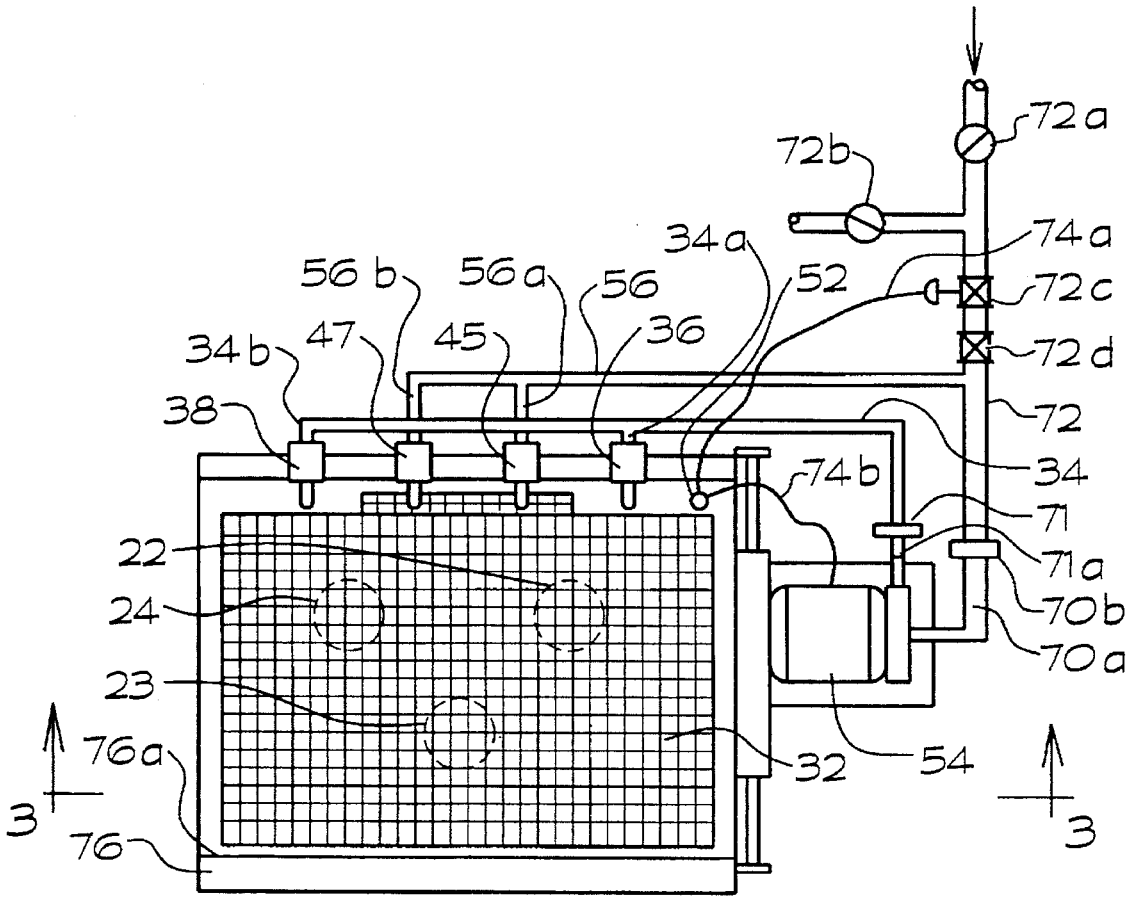
FIG. 2 is a top view of the preferred embodiment of FIG. 1 including additional features of the present invention.
Figure 3:
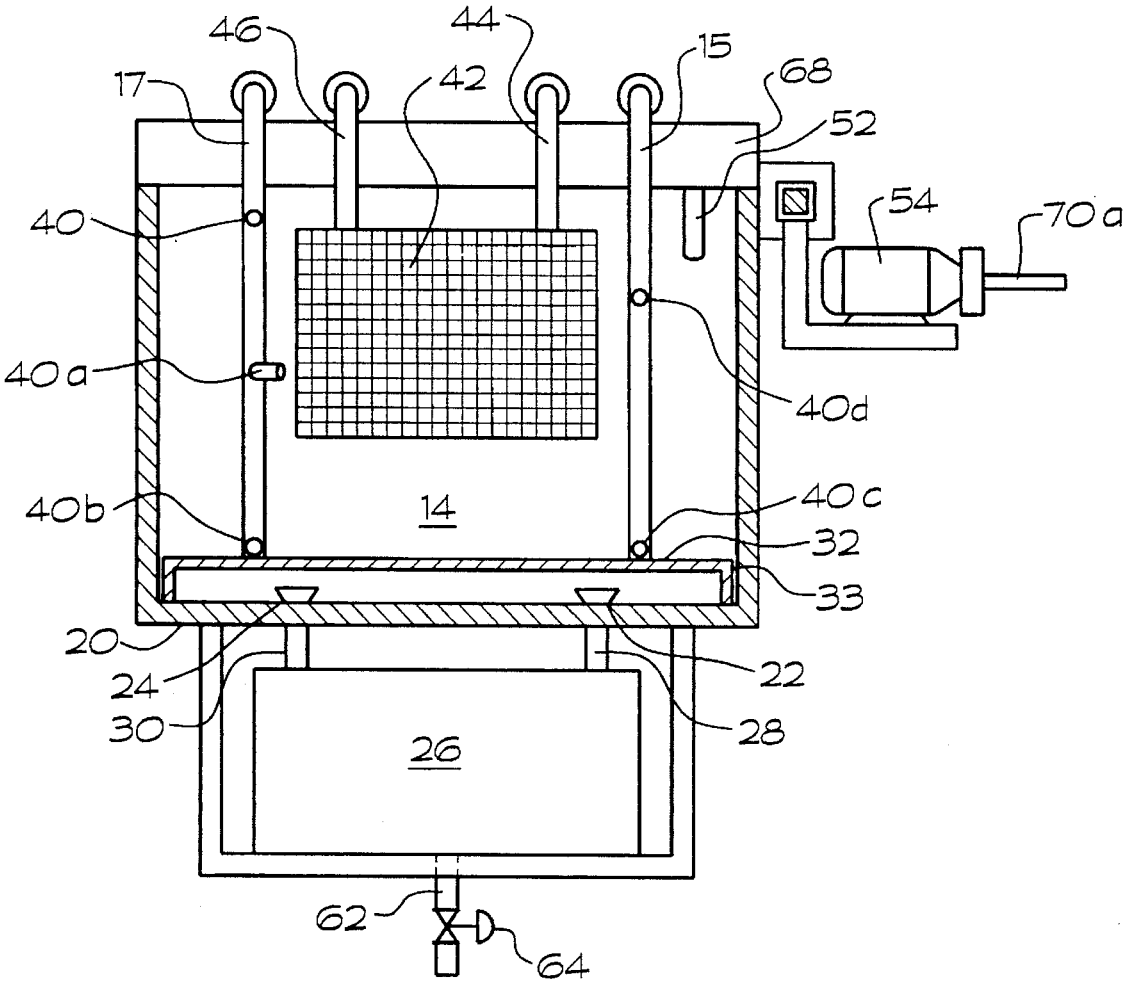
FIG. 3 is a cross-sectional view taken along lines 3—3 of FIG. 2.

As best shown in FIGS. 1, 2 and 3, the pre-wash system 12 includes a spray jet manifold 34 which is generally positioned along the back of the sink 10. The spray jet manifold 34 is in flow communication with water inlet conduits 34*a*, 34*b* and pump 54 through discharge conduit 71*a* which is connected to the high pressure or discharge side of the recirculating pump 54. Inlet conduits 34*a*, 34*b* are in flow communication with vertically extending conduits 15 and 17, respectively. The vertically extending conduits 15 and 17 are spaced along an inner surface of back wall 14 and include spray nozzles spaced at preselected vertical positions therealong.

Figure 4:
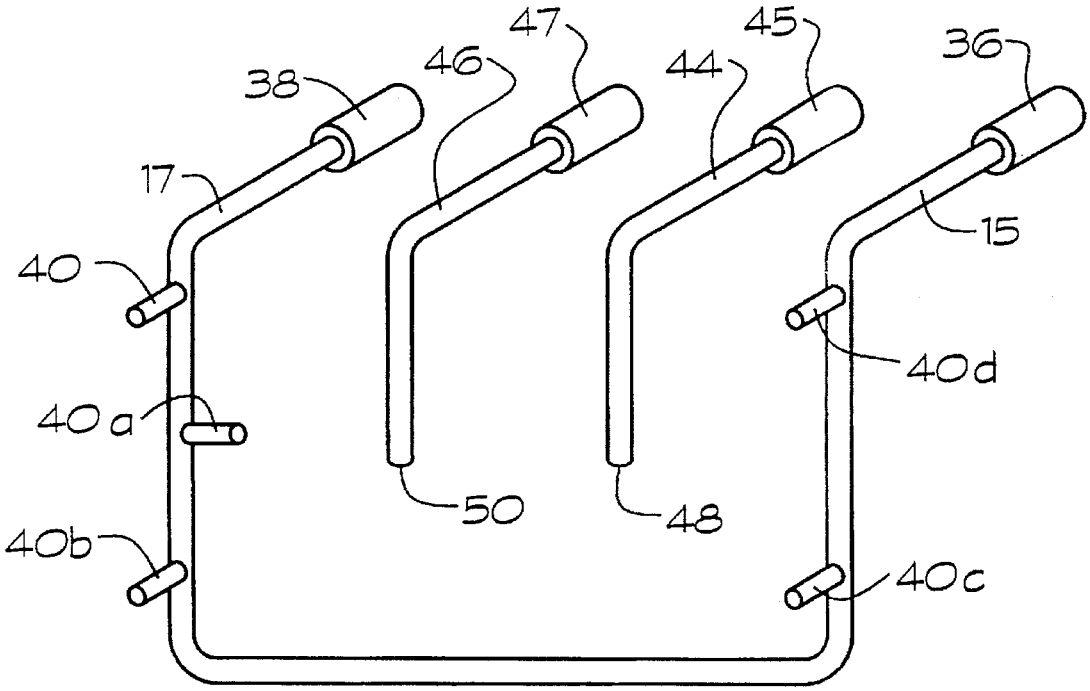
FIG. 4 is a perspective view of selected portions of the preferred embodiment of the present invention.
Figure 8:
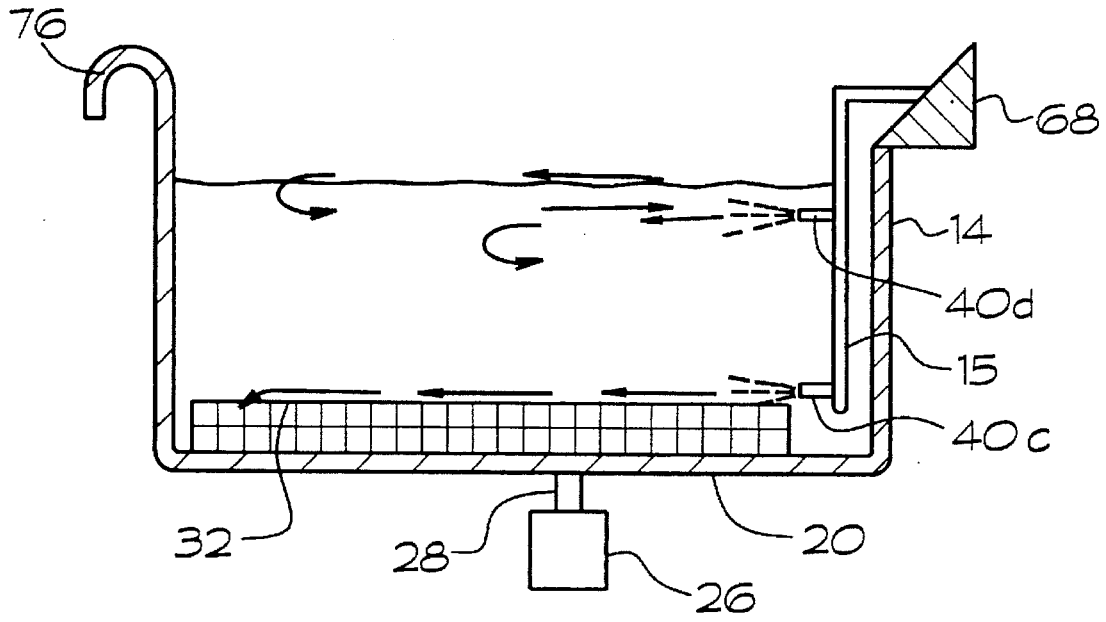
FIG. 8 is a sectional side view, of selected portions of the preferred embodiment of the present invention showing the flow pattern of the circulating wash water.
Figure 9:
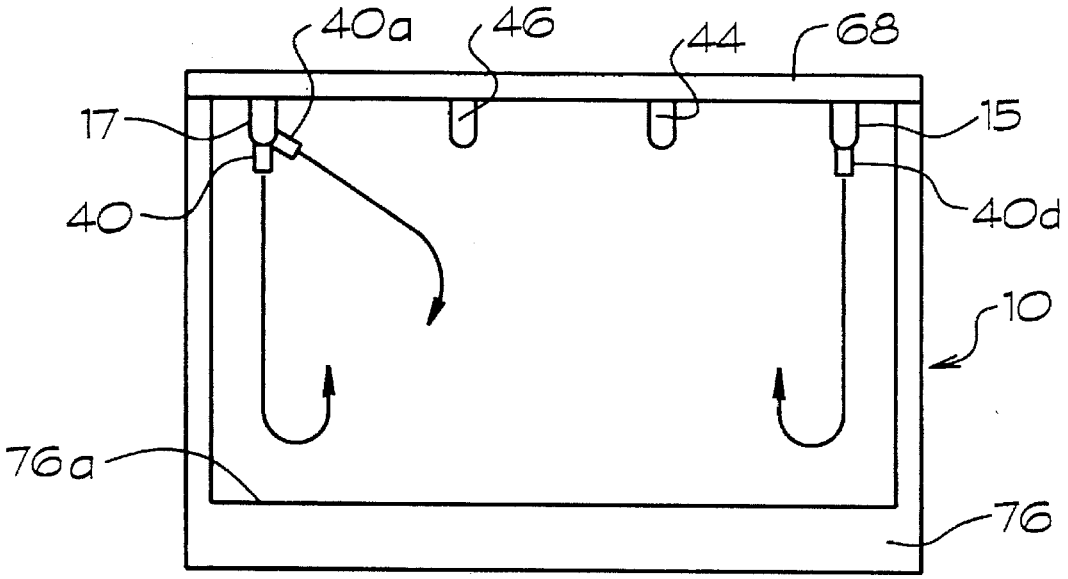
FIG. 9 is a top view of selected portions of the preferred embodiment of the present invention showing another view of the flow pattern of the circulating wash water; and, FIG. 10 is a perspective view with selected portions cut-away of another embodiment of a filter for the liquid return conduits of the present invention.

As shown in FIGS. 1, 3, and 4, three of the spray nozzles 40, 40*a* and 40*b* are disposed along the vertical conduit 17 and two of the spray nozzles 40*c* and 40*d* are disposed along the vertical conduit 15. Generally, the spray nozzle 40 is at about the desired water level in sink 10 and spray nozzle 40*b* is positioned vertically downward at a location in line with the top of a porous filter plate 32, to be discussed hereinafter, which covers bottom wall 20 of sink 10. Disposed approximately equal distance between nozzles 40 and 40*b* is spray nozzle 40*a*. Approximately equal distance vertically between nozzles 40 and 40*a* on conduit 17 is spray nozzle 40*d* on conduit 15. Spray nozzle 40*c* is generally positioned in the same horizontal plane as spray nozzle 40*b*. In the horizontal alignment of the spray nozzles, spray nozzles 40, 40*b*, 40*c*, and 40*d* are disposed to spray toward the front wall 76*a* of sink 10 and spray nozzle 40*a* is disposed to spray at an angle of from 15° to 60° away from wall 76*a*, and preferably at an angle of about 45° toward the center of the sink. Water flow patterns for this spray nozzle arrangement is shown in FIGS. 8 and 9.

The vertically extending conduits 15 and 17 are provided with quick disconnect couplings 36 and 38 which are easily connected and disconnected from the terminating ends of water inlet conduits 34*a* and 34*b*, respectively. Water inlet conduits 34*a* and 34*b* are preferably mounted through a splash plate 68 which is attached to the upper portion of the back wall 14 of the sink 10. Splash plate 68 may be attached by any well known, easy removable attaching means for attachment to an existing sink.

The pre-wash system 12 is also provided with a wash water return means for re-circulation of the water in the sink 10. The wash water return means includes a pair of vertically extending conduits 44 and 46 disposed along an inner surface of the back wall 14 which are in flow communication with the suction side of the pump 54. The vertically extending return conduits 44, 46 are provided with openings 48, 50, (FIG. 4), respectively, at their terminating ends in the sink 10. The openings 48, 50 are generally positioned at a preselected vertical position from the bottom wall 20 of the sink 10. The return conduits 44, 46 are also provided with quick disconnect couplings 45, 47, respectively, which, as best shown in FIG. 2, are in flow communication with the inlet conduits to the pump 54. As shown in FIGS. 1 and 2, conduit 44 is in flow communication through conduit 56*a* to flow-through conduit 56 and conduit 46 is in flow communication through conduit 56*b* to flow-through conduit 56. Return flow-through conduit 56 merges with fresh-water supply conduit 70 to form the suction lines for pump 54. Suction intake 70*a* to pump 54 is in flow communication with conduit 70.

Figure 10:
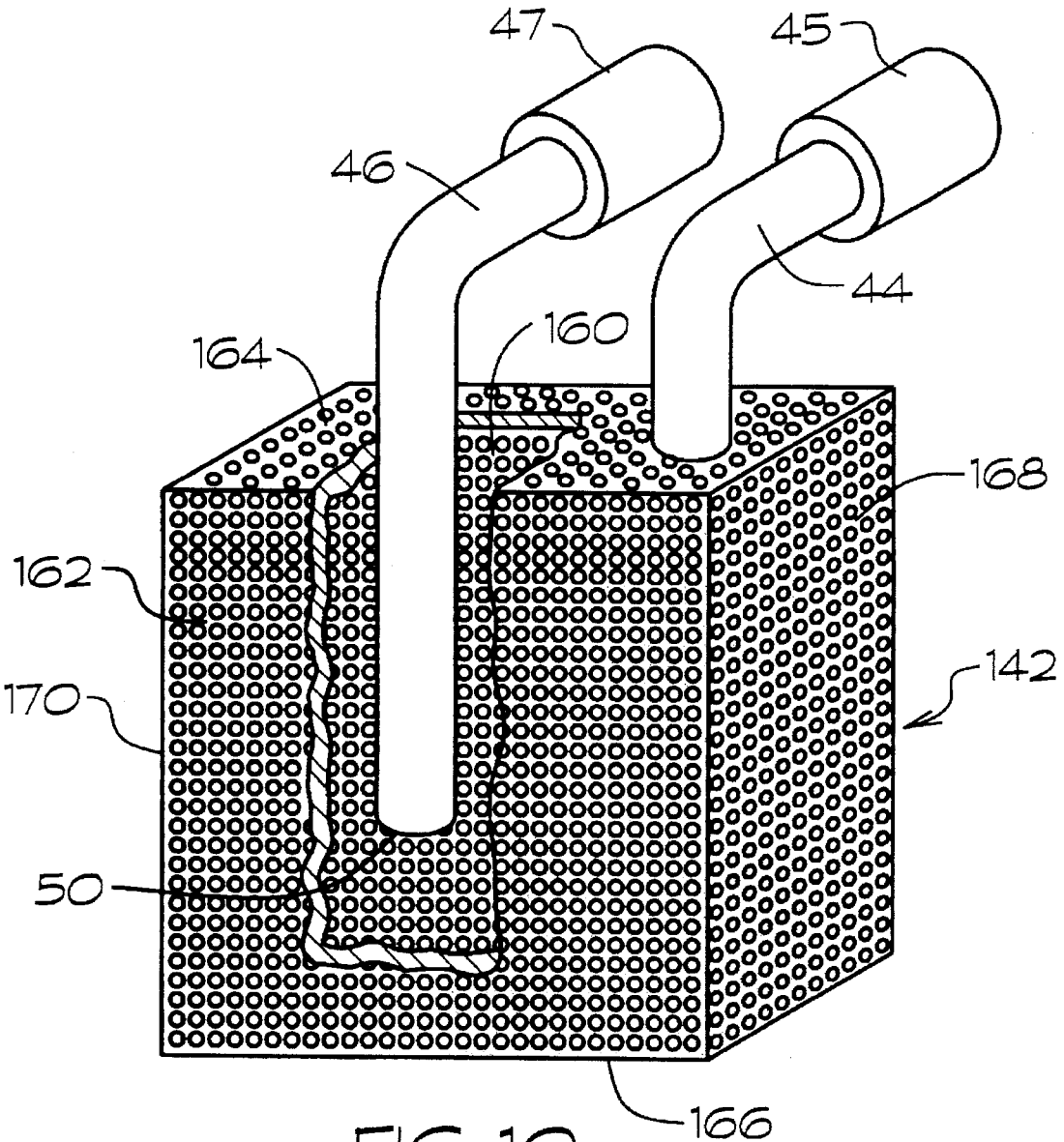

A back wall grid or porous filter plate 42 is provided along the back wall 14 and particularly over the inlet openings 48 and 50 for the re-circulating conduits 44 and 46. The porous plate 42 is generally a thin sheet of stainless steel with a plurality of openings therein. One preferred porous filter plate 42 is a 304 stainless steel with ⅛" openings therethrough at ¼ spacings thereby providing for an open area of approximately 40% of the sheet. Generally, sheet 42 is provided with turned edges around the outer periphery of the sheet 42 thereby spacing filter plate 42 from the back wall 14. Cut-outs along one top turned edge are provided to receive conduits 44, 46 therethrough. Alternatively, as shown in FIG. 10, a porous filter plate 142 may also be provided in lieu of filter plate 42. Filter plate 142 is provided with a back porous wall 160, a front porous wall 162, a top porous wall 164, a bottom porous wall 166 and two side porous walls 168 and 170. Openings 172 and 174 are provided in the top wall 164 for receipt of conduits 44 and 46 therethrough. In this embodiment, filter plate 142 and conduits 44 and 46 with quick disconnect couplings 45 and 47 may be assembled as one unit of the pre-wash system 12 of the present invention.

Figure 7:
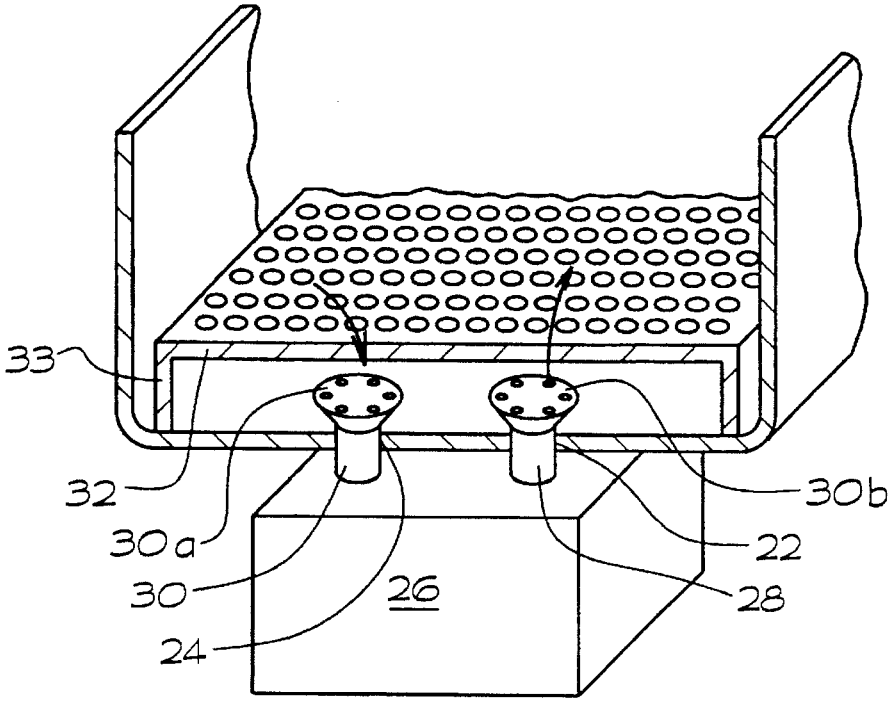
FIG. 7 is a perspective view, with selected portions cut-away, of a convection heat source of the present invention.

The bottom wall 20 is provided with at least openings 22 and 24 therein to provide flow communication between the pre-wash water in the sink 10 and a convection heater 26 which is disposed beneath the bottom wall 20 of the sink 10. Conduits 28 and 30 are provided on opposite sides of the heater 26 wherein the conduits 28 and 30 are in flow communication with the heater 26 and the openings 22 and 24, respectively, in the bottom wall 20. As best shown in FIG. 7, inlet or cold water flows into the heater 26 through conduit 30 and heated water flows out of the heater 26 through conduit 28. Preferably, at the openings of conduits 28 and 30 into the sink 10, filters 30*b* and 30*a*, respectively, are placed over the openings to prevent solid particulates from getting into the heater. As shown in FIG. 7, conduits 28 and 30 extend through openings 22 and 24 and filter plate 32 with turned down edge portions 33 around the outer periphery of filter plate 32 is spaced above the conduits 28 and 30. The perforated filter plate 32 is provided to cover a large portion of the bottom wall 20 of the sink 10 and particularly the openings 22 and 24. The perforated sheet 32 is generally made of the same material as the perforated plate 42 with the holes being the same size and the spacing therebetween being generally approximately the same thereby providing for a filter over the openings 22 and 24 to prevent solid particulates getting into the heater 26. The heater 26 is also generally provided with a drain outlet 62 which includes a hand operated valve 64 thereon for discharge of water from the sink 10 and the heater 26.

The pre-wash system 12 may also include a level control 52 which is, as best shown in FIG. 2, in electrical communication through appropriate electrical wiring identified by the numeral 74*a* to the solenoid valve 72*c* and 72*b* which is disposed in the fresh water inlets to conduit 70 as well as electrical communication through electrical lines 74*b* to pump 54. Solenoid valve 72*c* is energized to open for an initial fill of the sink 10 and upon the fill reaching a desired level as determined by level control 52, valve 72*c* closes and pump 54 is actuated. During the fill of the sink 10 fresh water through conduit 70 creates a back-flush through the return lines 56, 56*a*, 56*b* and the vertical return conduits 44, 46 into sink 10. Moreover, filter plate 72 is also back-washed during the initial fill. Check valves 72*a* and 72*b* are provided to prevent flow of return water from conduit 56 into the fresh water make-up lines. Even further, solenoid valve 72*c* may be integral with a flow control valve which regulates the rate of flow as the sink 10 fills or a separate flow control valve 72*d* may be provided.

Figure 5:
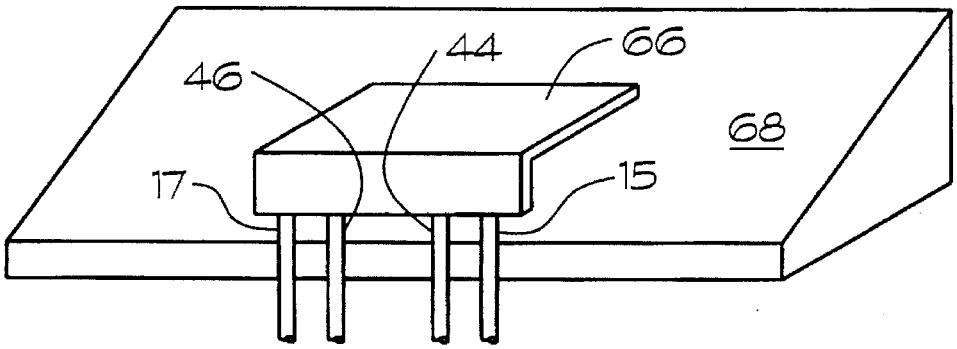
FIG. 5 is a perspective view of other selected portions of the present invention.

As best shown in FIG. 5, the pre-wash system 12 may also include a gravity held removable cover 66 along the back wall 14 which covers the quick disconnect couplings for the inlet and outlet conduits to the pre-wash system 12.

Figure 6:
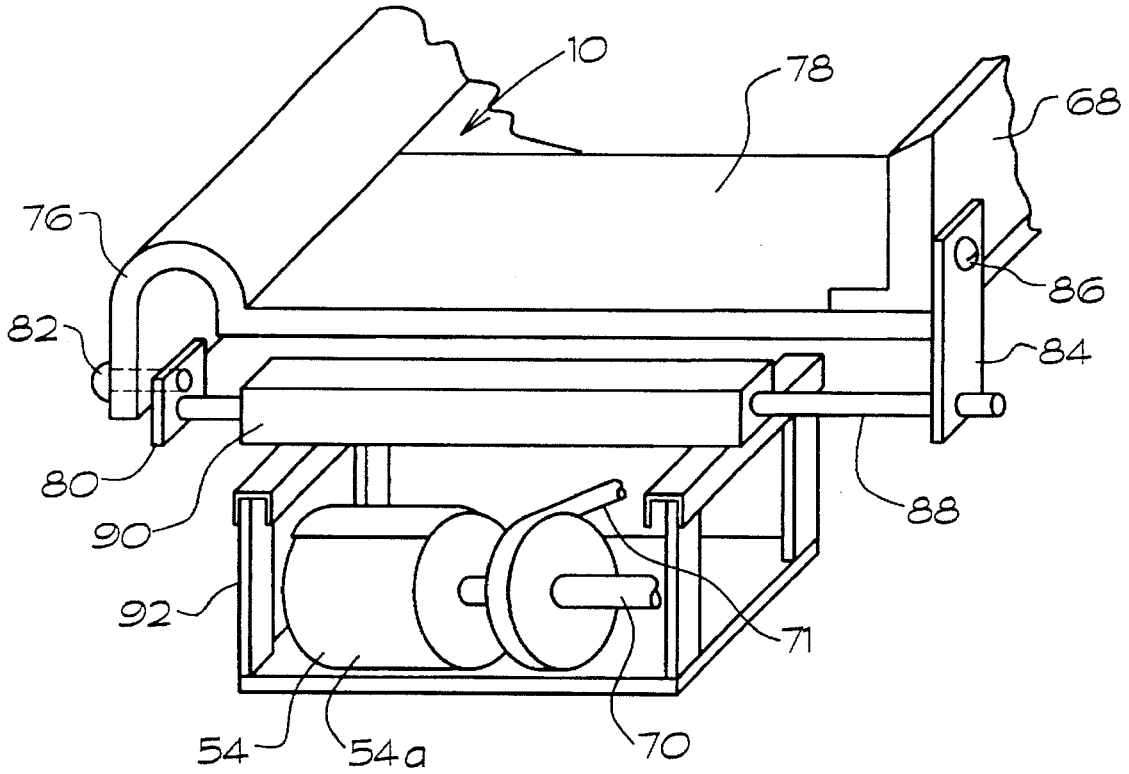
FIG. 6 is a perspective view of one preferred mounting for a pump of the present invention.

As best shown in FIG. 6 is one preferred means to mount the pump 56. In FIG. 6, the arrangement is such that the pump 56 may be quickly and easily installed for use with sinks of varying sizes. As shown, a flange 80 is attached by bolt 82 to a front rolled edge 76 of a drain board 78 which is adjacent to the sink 10 in which the pre-wash system 12 is installed. A second flange 84 is attached by a bolt 86 to the splash board 68. An elongated support rod 88 extends between and is received by flanges 80 and 84. A square tube 90 having a through-bore of preselected size receives the support rod 88 therethrough, square tube 90 being shorter than rod 88. A support frame 92 in which pump 54 including motor 54*a* is held is attached to the tube 90 which is moveable along rod 88. With tube 90 being shorter than rod 88, the support frame 92 of one size is mountable onto drain boards of various sizes. Moreover, as shown in FIG. 2, quick disconnect fittings 71*b* for discharge conduit 71*a* and 70*b* for suction intake 70*a* allows for quick and easy disconnect of pump 54 from its suction and discharge piping. In lieu of quick disconnect fittings 70*b* and 71*b*, other appropriate male-female plumbing connections may be used.

It is realized that various changes may be made by those skilled in the art without departing from the principals and scope of the invention as expressed in the claims appended hereto.

What is claimed is:

1. A recycle wash water system for a sink, the system comprising:

a pump;

spray means in flow communication with a discharge of said pump, said spray means being disposed for spray positioning along an inner surface of a back wall of a sink;

liquid return conduits in fluid communication with an intake side of said pump, said return conduits being disposed for positioning along the inner surface of said back wall; and, filter means disposed over flow-through openings into said return conduits.

2. The wash water system of claim 1 including a level control means.

3. The wash water system of claim 2, wherein said level control means is in electrical communication with a solenoid valve in a fresh water supply source and said pump.

4. The wash water system of claim 1, said spray means being in flow communication with a fresh water supply source.

5. The wash water system of claim 1 including heat means, said heat means being disposed for positioning beneath said sink and in heat transfer relation with an interior in said sink.

6. The wash water system of claim 1, said spray means including a quick disconnect coupling in connect-disconnect relationship with a fluid conduit in flow communication with the discharge side of said pump.

7. The wash water system of claim 1 wherein said liquid return conduit are provided with a quick disconnect coupling in connect-disconnect relationship with an inlet conduit in flow communication with the intake side of said pump.

8. The wash water system of claim 1 wherein said spray means includes a pair of spaced vertically extending inlet conduits positioned to extend along the back wall of said sink, a first vertically extending inlet conduit having three spray nozzles therein at preselected positions along said conduit and a second opposed spaced vertically extending inlet conduit having two spray nozzles positioned at a preselected distance along said second vertically extending conduit.

9. The wash water system of claim 8 wherein said first vertically extending inlet conduit includes a first spray nozzle at a preselected position in an upper region of said first inlet conduit, a second spray nozzle spaced downwardly from said first spray nozzle a preselected distance, and a third spray nozzle spaced downwardly from said second spray nozzle a preselected distance, said second inlet conduit having a fourth spray nozzle spaced in substantially horizontal alignment with said third spray nozzle and a fifth spray nozzle spaced vertically at a preselected position between said first and said second spray nozzle.

10. The wash water system of claim 9, said first, third, fourth and fifth nozzles being directed toward a front wall of a sink, said second spray nozzle being directed away from said front wall at an angle of from 15° to 60° toward an interior of said sink.

11. The wash water system of claim 10, said fourth spray nozzle being at an angle of about 45°.

12. The wash water system of claim 8, said liquid return conduits including a pair of spaced vertically extending water return conduits positioned to extend along the back wall of said sink, said spaced vertically extending water return conduits positioned between and spaced from said first and said second vertically extending inlet conduits.

13. The wash water system of claim 12, said pair of spaced vertically extending water return conduits having terminating ends positioned for spacing above a bottom wall of said sink.

14. In combination with a sink having a back wall, side walls, and a bottom wall with at least one opening in said bottom wall, a wash water system comprising:

a pump;

spray means in flow communication with a discharge of said pump, said spray means being disposed for spray positioning along an inner surface of the back wall of the sink;

liquid return conduits from said sink to an intake side of said pump, said return conduits being positioned along an inner surface of said back wall;

first filter means disposed over flow-through openings into said return conduits; and, heat means in heat exchange relation with a heating water conduit in flow communication with said opening in said bottom wall.

15. The wash water system of claim 14 including a level control means.

16. The wash water system of claim 15, wherein said level control means is in electrical communication with at least one solenoid valve in a fresh water supply source and said pump.

17. The wash water system of claim 14, said spray means being in flow communication with a fresh water supply source.

18. The wash water system of claim 14, said spray means including a quick disconnect coupling in connect-disconnect relationship with an outlet fluid conduit in flow communication with the discharge side of said pump.

19. The wash water system of claim 14, wherein said liquid return conduits are provided with a quick disconnect coupling in connect-disconnect relationship with an inlet conduit in flow communication with the intake side of said pump.

20. The wash water system of claim 14 wherein said spray means includes a pair of spaced vertically extending inlet conduits extending along the back wall of said sink, a first vertically extending conduit having three spray nozzles therein at preselected positions along said first conduit and a second opposed spaced vertically extending inlet conduit having two spray nozzles positioned at a preselected distance along said second vertically extending conduit.

21. The wash water system of claim 20 wherein said first vertically extending inlet conduit includes a first spray nozzle at a preselected position in an upper region of said first inlet conduit, a second spray nozzle spaced downwardly from said first spray nozzle a preselected distance, and a third spray nozzle spaced downwardly from said second spray nozzle a preselected distance, said second inlet conduit having a fourth spray nozzle spaced in substantially horizontal alignment with said third spray nozzle and a fifth spray nozzle spaced vertically at a preselected position between said first and said second spray nozzle.

22. The wash water system of claim 20, said first, third, fourth and fifth nozzles being directed toward a front wall of a sink, said second spray nozzle being directed away from said front wall at an angle of from 15° to 60° toward an interior of said sink.

23. The wash water system of claim 22 including a second filter means over said opening in said bottom wall, said third and fourth nozzles positioned to spray across a top of said second filter means.

24. The wash water system of claim 23, said second filter means being spaced a preselected distance above the bottom wall and cover substantially the upper surface of said bottom wall.

25. The wash water system of claim 24 including a third filter means spaced between said second filter means and said bottom wall, said third filter means covering said at least one opening.

26. The wash water system of claim 24, said second filter means being a porous plate of rectangular configuration with downwardly turned edges extending the entire periphery of said porous plate, the height of said downwardly turned edges defining the spacing between said bottom wall and said second filter means.

27. The wash water system of claim 22, said fourth spray nozzle being at an angle of about 45°.

28. The wash water system of claim 20, said liquid return conduits including a pair of conduits positioned to extend along the back wall of said sink, said spaced vertically extending water return conduits positioned between and spaced from said first and said second vertically extending inlet conduits.

29. The wash water system of claim 28, said pair of spaced vertically extending water return conduits having terminating ends positioned for spacing above a bottom wall of said sink, said terminating ends having said flow-through openings therein.

30. The wash water system of claim 14 including a second filter means over said opening in said bottom wall.

31. The wash water system of claim 14, said at least one opening in said bottom wall including an inlet opening in flow communication with said heat means and an outlet opening in flow communication with said heat means.

32. The wash water system of claim 31, said heat means being a convection heater.

33. The wash water system of claim 14, said sink including a drain board extension from one of said sides, said pump including a pump motor mounted beneath said drain board.

34. The wash water system of claim 33, including a support for said pump, said support including a telescoping attaching means attachable to said drain board.

35. The wash water system of claim 34, said telescoping attaching means including a square tube mounted onto a cylindrical rod, said tube being shorter than said rod, said rod being detachably connected on one end to a first flange attached to one wall of said drain board and an opposite end of said rod being received by a second flange attached to an opposite wall of said one wall of said drain board.

36. The wash water system of claim 14, said pump including a first inlet conduit and a first outlet conduit, each of said conduits having quick disconnect couplings in connect-disconnect relationship with a second inlet conduit and a second outlet conduit, said second inlet conduit being in flow communication with said liquid return conduits, said second outlet conduit being in flow communication with said spray intake jet manifold.

37. The wash water system of claim 14 including a level control means in electrical communication with at least one solenoid valve and a flow regulating valve in a fresh water supply source and said pump.

* * * * *